United States Patent [19]

Schadlich

[11] Patent Number: 4,622,779

[45] Date of Patent: Nov. 18, 1986

[54] METHOD AND APPARATUS FOR SPEED CONTROL OF A GRINDER

[75] Inventor: Fritz Schadlich, Leinfelden-Echterdingen, Fed. Rep. of Germany

[73] Assignee: Robert Bosch GmbH, Stuttgart, Fed. Rep. of Germany

[21] Appl. No.: 686,282

[22] Filed: Dec. 26, 1984

[30] Foreign Application Priority Data

Jan. 11, 1984 [DE] Fed. Rep. of Germany ..... 3400672

[51] Int. Cl.[4] ..... H02P 5/00; B24B 5/00

[52] U.S. Cl. ..... 51/134.5 R; 318/332

[58] Field of Search ..... 51/165.71, 165 TP, 165.92, 51/134.5; 318/301, 341, 332, 314, 317, 345 R

[56] References Cited

U.S. PATENT DOCUMENTS 2,768,331 10/1956 Cetrone ..... 318/317 X
3,704,556 12/1972 Nedreski ..... 51/134.5 R
4,097,787 6/1978 Larsson et al. ..... 51/134.5 R X

FOREIGN PATENT DOCUMENTS 2211077 3/1972 Fed. Rep. of Germany .

*Primary Examiner*—Frederick R. Schmidt
*Assistant Examiner*—Debra S. Meislin
*Attorney, Agent, or Firm*—Frishauf, Holtz, Goodman & Woodward

[57] ABSTRACT

A signal representative of the mass moment of inertia of a grinding wheel and its drive motor is integrated for a fixed time interval during start-up of the motor beginning when the motor speed or the motor current has reached a predetermined small value, and the integration result is stored until the integrator and storage circuit are reset by a new start-up operation. The integrator result is used to modify a voltage which represents a desired operating speed so as to compensate for differences in value of the mass moment of inertia, making the desired speed smaller when the mass moment of inertia is greater, and vice versa. The result is to hit the desired speed in a manner compensating for the wearing down of the diameter of the grinding wheel, so that the peripheral speed of the grinding wheel is regulated at a substantially constant speed, even though in successive start-ups the grinding wheel diameter diminishes. The integrated signal may be the motor current which varies directly with the mass moment of inertia, or the rotary speed of the shaft which varies inversely with the mass moment of inertia. Sensitivity to changes in diameter is greater when the operating voltage is reduced during start-up and at least until the end of the measuring interval.

8 Claims, 4 Drawing Figures

METHOD AND APPARATUS FOR SPEED CONTROL OF A GRINDER

This invention concerns the control of the speed of a grinder in a manner dependent upon the radius of the grinding wheel or disk, particularly in the case of grinders in which the wear on the grinding wheel or disk progressively reduces the diameter of the wheel or disk and especially in the case of a right-angle grinder.

A method and apparatus for the control of such a grinder is known from German published patent application (OS) No. 22 11 077 which discloses that it is important to monitor the grinding wheel or disk diameter and to raise the motor speed when that diameter becomes smaller, so that an approximately constant peripheral velocity results. In that disclosure, it is accordingly recommended to provide light-emitting diodes within the wheel guard around the portion of the revolving disk extending beyond the casing of a hand-held grinder motor for measuring optically the diameter of the disk. That arrangement is very expensive, however, so that it is not practical for mass-production of economically priced articles. It has furthermore been found that in operation of this device, errors in speed control are generated by the presence in the optical path of grinder dust and particles whirled around by the tool, leading to an unsettled running speed of the tool.

SUMMARY OF THE INVENTION

It is an object of the present invention to provide a speed control for a hand-held motor-driven grinder utilizing a grinding wheel of which the radius wears down during operation, in which the speed is automatically adjusted to changing wheel radius without interference in the operation of the speed control by dust or particles worn off the work or the wheel during operation.

Briefly, the effect of the mass moment of inertia of the grinding wheel is used for determining the speed, the mass moment of inertia being determined during start-up of the power grinder. In one embodiment the mass moment of inertia is determined by integrating the start-up current during a predetermined interval of time and in another embodiment, it is determined by integrating the speed of revolution of the grinder during a predetermined start-up interval.

By the formation of the integral of the start-up current over a predetermined time interval, disturbing influences are to a great extent filtered out, and it is possible to recognize even slight changes in the grinding wheel diameter. The start-up current is a magnitude that is easy of access in an electrical tool, so that the invention is usable for retrofitting existing grinders. It is likewise advantageous to utilize the rotary speed in a start-up period for integration in order to have a measure of the mass moment of inertia.

The power grinder according to the invention can accordingly be equipped with a control system for producing a constant rotary speed operating in a manner dependent upon the mass moment of inertia. With speed control grinders in accordance with the invention, it is possible to obtain a desired effect in a simple way by picking up a supplementary magnitude electrically. As already mentioned, in practice it is advantageous to integrate a signal proportional to the current or the rotary speed of the motor in an integrating circuit and to store the integrated value in a storage component of the overall circuit. The signal thus obtained is then fed into the control system in such a way as to obtain a constant peripheral speed of the grinding wheel. The supplementary electronics in that kind of constitution of a control system are remarkably simple and economical. For generating the signal in the start-up phase of the drive motor, a timing circuit is switched on as soon as either the current or the rotary speed has exceeded a predetermined value. In that way, it is assured that a time constant for the integration or the measurement is determined in a simple way and, furthermore, the effect of large tolerances in indirect starting of the motor are suppressed by somewhat delayed switching of the Schmitt trigger to start the measurement. In order to obtain a particularly fine sensitivity of control, it is advantageous to provide certain defined reduction of the supply voltage while the motor runs up to operating speed.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
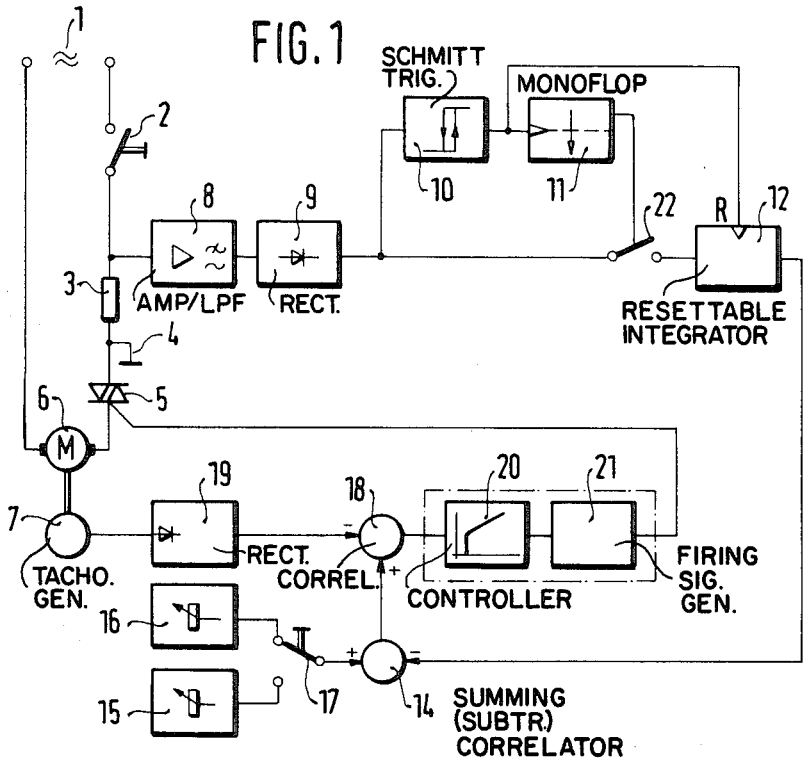
FIG. 1 is a circuit block diagram of a first embodiment of a grinder speed control system according to the invention.

FIG. 1 shows a power cord connector 1 from which a first conductor leads directly to a motor 6 and a second conductor leads to a switch 2. The switch 2 is connected to the terminal of a resistance 3, of which the other terminal is connected to apparatus ground, for example a connection to the frame or casing of the motor, which may also be connected to an external ground by means of a ground conductor, not shown in the drawing, when the power cord connector as a third prong for a ground connection, as is often provided in the case of electrical tools.

From the grounded end of the resistor 3, there is also a connection to one terminal of a triac 5 which has another terminal connected with the motor 6.

An amplifier 8 is connected to the common connection of the switch 2 in the resistance 3 and functions both as an amplifier and as an active low-pass filter. A rectifier 9 follows the amplifier 8 and provides an output to a switch 22, as well as to a Schmitt trigger 10. The output of the Schmitt trigger 10 is connected to a monostable multivibrator (monoflop) 11, which switches back to its stable state when a predetermined interval has elapsed after its setting by the Schmitt trigger circuit 10. The switch 22 is connected so as to be actuated by the output of the monoflop 11. The terminal of the switch 22, which is not connected to the output of the amplifier 8, is connected to an integrator 12 which is also connected to be reset through its reset terminal R by the positive-going flank of the Schmitt trigger output. The output of the integrator 12 is supplied to an input of the correlating circuit 14.

The correlating circuit 14 can, for example, be constituted as an amplifier that performs an algebraic addition. There is also connected to it a transfer terminal of a switch 17 by which either the signal of the potentiometer 15 or that of the potentiometer 16 can be supplied to the correlating circuit 14 for being reduced there by the input signal from the integrator 12. The output signal of the correlation circuit 14 leads to a second correlation circuit 18 which likewise can be constituted as an amplifier with two inputs for producing an algebraic (again a subtraction). The output signal of a rectifier 19 is supplied in a negative sense to the correlation circuit 18, so that it will be subtracted from the output signal of the correlation circuit 14. The input signal of the rectifier 19 comes from a tachogenerator 7 connected to it. The tachogenerator 7 is fixedly coupled to the motor 6. The output of the correlation circuit 18 is then supplied to a PI controller 20, which in turn supplies its output to a firing signal generator for the triac 5. The controller 20 and the firing signal generator 21 can together be constituted, for example, by a single integrated circuit unit of the type designation U 111B obtainable from AEG-Telefunken.

Figure 2:
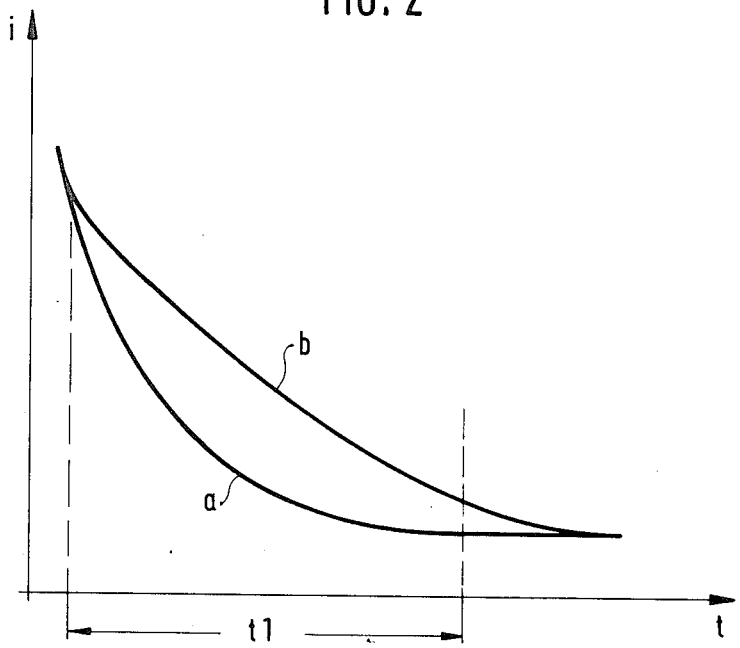
FIG. 2 is a graph of current against time for explaining the manner of operation of the embodiment of FIG. 1.

The operation of the circuit of FIG. 1 is best explained with reference to FIG. 2, which shows the time course of current in the start-up phase of an electric grinder. The curve a designates the course of the current when the grinding wheel has a small diameter, while the curve b shows the current when the wheel has a large diameter. Since in the case of small diameter the wheel is more readily accelerated, the current sinks more rapidly towards its final operating value during the initial phase of operation. This feature is utilized in the circuit of FIG. 1 for holding constant the peripheral velocity of the grinding wheel. The time profile of current magnitude is picked as a voltage signal across the resistance 3 which has a very low resistance value, is freed of high-frequency disturbances in the low-pass filter constituted by the amplifier 8, and the signal thus obtained is then rectified. A voltage then appears at the output of the rectifier 9 which is proportional to the sensed current. If this voltage goes below a predetermined value, the Schmitt trigger circuit 10 changes state (flops over). This lower threshold of the Schmitt trigger circuit is shown in FIG. 2 by the vertical broken line near the left side of FIG. 2. In this manner, the result is obtained that the value of the start-up current is not picked up at the moment the tool is switched on, but rather slightly later. In this way, inaccuracies which might be noticeable as the result of differences in start-up behavior, are easily suppressed. In the first phase of start-up, differences in the mass moment of inertia of the wheel do not make themselves noticeable, so that the switching instant of the Schmitt trigger circuit 10, independently of the grinding wheel diameter, is very nearly constant. The monoflop circuit 11 is set by the Schmitt trigger 10 and in turn closes the switch 22. During the measuring interval $t_1$, the duration of which is timed by the monoflop 11, the voltage proportional to the motor current is now integrated and stored. After the measuring interval $t_1$ has elapsed, the switch 22 is opened and the integration result is then available. The reference value of motor speed that is set either by the potentiometer 15 or by the potentiometer 16 is then reduced by the signal obtained from the integrator 12 to provide a reference value that is dependent upon the grinding wheel diameter. The two potentiometers 15 and 16 are provided in order to make possible a choice of different rotary speeds, respectively for cutting or rough turning with the grinding wheel which typically is in the shape of a disk with a thin edge suitable for either cutting or rough-turning.

The tachogenerator provides an output representative of the momentary rotary speed. That signal is rectified so that a voltage proportional to rotary speed can be obtained from the output of the rectifier 19. The correlating circuit 18 provides what may be referred to as an error signal for the following PI controller 20 and the output of the latter provides the basis for furnishing firing pulses for the triac 5. As can readily be gathered from FIG. 2, the integral under the curve a is smaller than the integral under the curve b. This has the consequence that a fixed predetermined speed is reduced as the result of the correlation circuit 14 is reduced by the correlafion circuit 14 to an extent which increases with the magnitude of the wheel circumference. This means that when the wheel circumference is large, a smaller rotary speed is produced. In that way the peripheral speed can be held constant.

Figure 3:
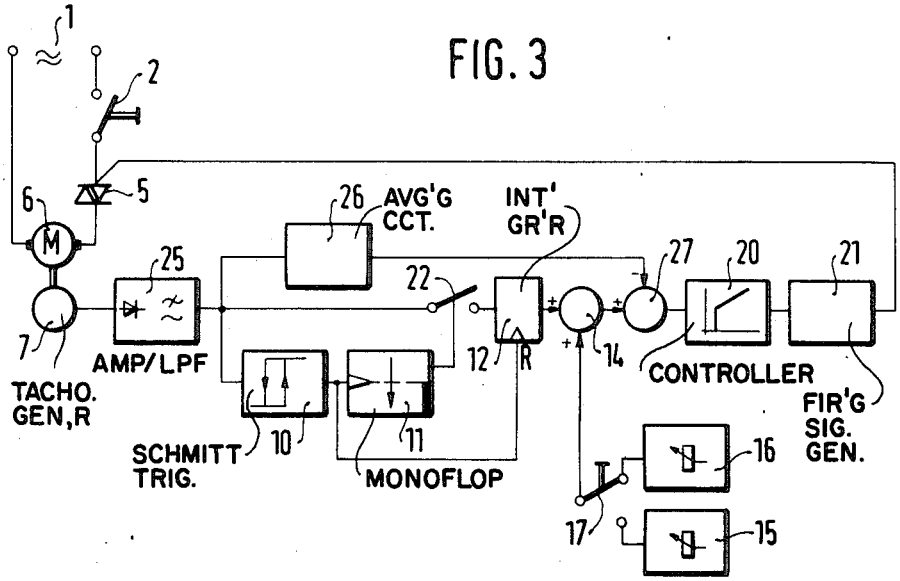
FIG. 3 is a block circuit diagram of a second embodiment of a grinder speed control system according to the invention.

FIG. 3 shows another embodiment of a control circuit for constant peripheral velocity of the grinding disk. In this case only the signal of the tachogenerator 7 is evaluated. From the power cord connector 1, there is again one conductor leading to the motor 6 while another conductor reaches the motor 6 only through the switch 2 and the triac 5. The tachogenerator 7 is again fixed with its rotary portion on the shaft of the motor and its fixed portion stationary, for example mounted on the motor casing or built into the motor. The output signal of the tachogenerator 7 goes to a a rectifying unit 25 containing a rectifier followed by a low-pass filter. The output of the rectifier unit 25 is connected to one contact of a switch 22, to the input of an averaging circuit 26 and to the input of a Schmitt trigger circuit 10 which with its output controls a monoflop 11. The output of the monoflop 11 controls the operation of the switch 22. The remaining contact of the switch 22 is for leading the output of the rectifier unit 25 to an integrating circuit 12 which has a reset input connected to the output of the Schmitt trigger circuit 10 so as to be reset by the positive-going flank of the output of the latter. As in the case of FIG. 1, the integrating circuit 12 is constituted for storing the integration result after the monoflop 11 opens the switch 22 until the circuit 12 is reset by the Schmitt trigger 10 at the same time that the switch 22 is closed again.

The output of the integrating circuit 12 is supplied to a correlating circuit **14*a* which also receives, as another input, a reference value signal obtained through the switch 17. The potentiometers 15 and 16 are connected to the switch 17 for providing selectable reference speed signals. Thus one potentiometer may for example provide the reference speed signal for rough turning and the other reference speed signal for cutting. The correlation circuit 14*a*, unlike the correlation circuit 14 of FIG. 1, works additively rather than subtractively, since a higher value of integrator output corresponds to lower mass moment of inertia, whereas the integration result in the integrating circuit 12 of FIG. 1 of the magnitude of current through the motor 6** is greater when there is a greater mass moment of inertia.

The output of the correlation circuit **14*a* then goes to the correlation circuit 27, which also receives, in an inverted sense, the output of the average value circuit 26, thus producing an output representative of the difference between the respective outputs of the correlation circuit 14a and the output of the average value circuit 26. The output of the second correlation circuit 27 goes, in a manner analogous to the circuit of FIG. 1, to a PI controller 20, which controls the circuit 21 for providing control pulses to the triac 5. The PI controller 20 and the control pulse generating circuit 21 can again be provided as a single integrated circuit and indeed it is also possible to include in that integrated circuit the correlation circuit 27. The integrated circuit unit U 111B available from AEG Telefunken can again be used in this portion of the circuit, just as in the corresponding portion of the circuit of FIG. 1**.

The manner of operation of the circuit of FIG. 3 is best explained with reference to FIG. 4, where the rotary speed n of the grinding wheel is plotted against time for a start-up of the motor from rest condition to operating speed. The curve a shows the course of the motor speed of the grinder having a grinding wheel of small diameter, while the curve b shows the course of the rotary speed when the grinding wheel has a large diameter. After the switching on of the tool, the motor 6 starts up slowly, as is made evident to the system by the rising of the signal at the output of the tachogenerator 7. This signal is rectified and filtered in the rectifier unit 25, so that high frequency disturbing pulses can have no effect on the operation of the speed control circuit. In a manner analogous to the case where the value of current is measured, disturbances are still to be expected immediately after turning on of the motor and consequently, the speed signal is made available to the control circuit through the Schmitt trigger circuit 10 only after the rotary speed has reached a certain value. In the start-up phase, the speed values differ so slightly right after switching on of the motor, that no disturbance of or error in measurement results from the delay.

The monoflop 11 is set by the output signal of the Schmitt trigger circuit 10, with the result that the switch 2 is closed by the monoflop 11. The switch 22 remains closed during the timing period $t_1$ of the monoflop. During this interval, the voltage provided at the output of the rectifier unit is integrated in the integrator 12. After the termination of the measurement interval, the integration is terminated and the last integration result remains applied to the correlation circuit 14a. The signal thus applied is additively combined with the reference speed signal obtained through the switch 17. The signal obtained by that additive combination is then compared with the signal representative of the contemporary actual speed of the grinder shaft. The actual speed signal, as furnished from the rectifier unit 25, however, is averaged over several revolutions of the grinder shaft in the circuit 26 before it is supplied to the comparison just mentioned, in order to exclude disturbing effects. The output signal (difference signal, error signal) of the correlation circuit 27 is then processed by the controller 20 and the pulse generating circuit 21 to fire the triac 5 in the conventional manner for stabilizing the motor speed in a manner that will minimize the difference between the actual motor speed and the modified reference speed value represented by the output signal of the correlation circuit 14a.

Figure 4:
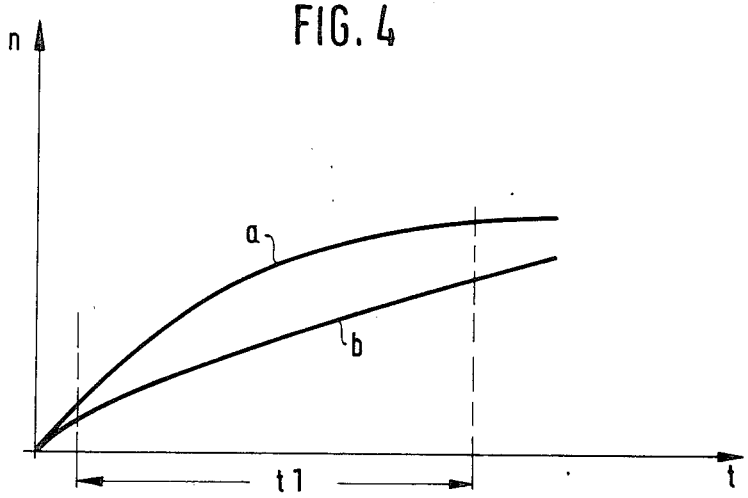
FIG. 4 is a graph of rotary speed against time for explanation of the manner of operation of the embodiment of FIG. 3.

As can be recognized from FIG. 4, the integral over the time $t_1$ becomes greater as the wheel circumference becomes smaller and likewise, therefore, as the radius becomes smaller. Since this integration value is additively combined with the reference speed value, the result is that with decreasing wheel diameter the speed of the motor (in revolutions per unit of time) is raised to such an extent that the peripheral speed of the wheel always remains constant. The circuit of FIG. 3, like the circuit of FIG. 1, is accordingly suited to hold constant the peripheral speed of the grinder wheel over successive operations, each beginning with a fresh startup of the motor.

The circuits of FIGS. 1 and 3 are particularly useful for making it possible to sense the wearing off of the rim of the grinding wheel in a right-angle grinder and thereby to operate a speed control for the grinder motor for holding the rotary speed of the wheel within an optimal speed range. Grinders thus equipped accordingly always provide an optimum peripheral velocity of the grinding wheel in spite of wearing off of the wheel rim and corresponding diameter reduction thereof.

The sensitivity of measurement can be raised further and the evaluation thereof accordingly made more easy and reliable if the running up to speed of the motor takes place at a defined reduction of operating voltage. This can, for example, be obtained in a simple manner by providing a series resistance that can be switched into the current supply circuit during the measurement interval or by providing that a certain firing angle for the triac 5 will be set in the pulse generator 21 during the measuring interval.

I claim:

1. Method of controlling the rotary speed of a grinding wheel driven by an electric motor, said grinding wheel and a rotary drive portion of said motor together having a mass moment of inertia and said electric motor having an electric power input and an operating current during operation thereof, in which method said speed of said wheel is controlled in a manner compensating for changes in wheel diameter, comprising the steps of:

producing, during a start-up interval of said motor, an electrical magnitude which is representative of the mass moment of inertia of said grinding wheel and said rotary drive portion of said motor, by integrating an electrical magnitude repersentative of the value of the operating current of said motor over a time interval of predetermined duration beginning when said operating current value first exceeds a predetermined current value;

storing said electrical magnitude representative of said mass moment of inertia;

providing an electrical signal representative of a predetermined reference speed and modifying said electrical signal representative of a predetermined reference speed by reducing it by the value of said stored electrical magnitude to obtain a modified reference speed signal;

generating a signal representative of actual speed of said grinding wheel;

comparing said signal representative of actual speed of said grinding wheel with said modified reference speed signal, to obtain a difference signal, and minimizing said difference signal representative of actual grinding wheel speed and said modified reference speed signal by varying the electrical power input to said motor and thereby controlling the speed of said grinding wheel.

2. Method of controlling the rotary speed of a grinding wheel driven by an electric motor having an electric power input and an operating current during operation thereof, said method being for controlling the rotary speed of said grinding wheel in a manner compensating for changes in wheel diameter, and comprising steps of:

generating a first electrical signal representative of actual speed of said grinding wheel;

integrating the magnitude of said first electric signal over a time interval of predetermined magnitude beginning when said first electrical signal representative of actual speed first exceeds a predetermined actual speed value following a startup of said motor from rest towards its operating speed, and then, at the end of said time interval, storing the electrical magnitude produced by integrating said first signal over said time interval;

providing a second electrical signal representative of a predetermined reference speed;

augmenting said second electrical signal representative of a predetermined reference speed by the magnitude of said stored electrical magnitude to provide a modified reference speed signal;

comparing said first electrical signal representative of actual speed of said grinding wheel with said modified reference speed signal to produce a difference signal, and minimizing said difference signal by varying the electrical power input to said motor and thereby controlling the speed of said grinding wheel.

3. Apparatus for controlling the rotary speed of a grinding wheel driven by an electric motor energized by operating current for said motor supplied to said motor at an operating voltage, with compensation of the rotary speed for change in diameter of the grinding wheel, comprising tachogenerator means for producing a first electrical signal representative of actual rotary speed of said grinding wheel and further comprising:

means for defining measuring interval of fixed duration during each start-up interval of the motor;

means for producing a second electrical signal representative of the magnitude of operating current of said motor;

means for integrating said second signal during said measuring interval and storing the integration result to produce a stored integrator ouput signal;

means for providing a third electrical signal representative of a predetermined reference speed of said grinding wheel;

means for reducing said third signal representative of a predetermined reference speed by said stored integrator output signal to produce a modified reference speed signal;

means for comparing said first signal representative of actual rotary speed with said modified reference speed signal to produce a difference signal, and means responsive to said difference signal for controlling the speed of said motor in a manner minimizing said difference signal.

4. Apparatus according to claim 3, in which said means for defining a measuring interval includes means for determining the beginning of said measuring interval by detecting when the magnitude of operating current of said motor first exceeds a predetermined value of operating current during start-up of said motor and timing circuit means responsive to said interval beginning determining means for timing the duration of said interval.

5. Apparatus according to claim 3, in which means are provided for reducing the operating voltage of said electric motor during start-up thereof at least until the end of said measuring interval.

6. Apparatus for controlling the rotary-speed of a grinding wheel driven by an electric motor energized by electric current supplied to said motor at an operating voltage, with compensation of the rotary speed for change in diameter of the grinding wheel, comprising tachogenerator means for producing a first electrical signal repersentative of actual rotary speed of said grinding wheel, and further comprising:

means for defining a measuring interval of fixed duration during each start-up interval of the motor;

means for integrating said first signal representative of actual rotary speed during said measuring interval and storing the integration result to produce a stored integrator output signal;

means for providing a second electrical signal representative of a predetermined reference speed of said grinding wheel;

means for augmenting said second signal representative of a predetermined reference speed by said stored integrator output signal to produce a modified reference speed signal;

means for comparing said first signal representative of actual rotary speed with said modified reference speed signal to produce a difference signal, and means repsonsive to said difference signal for controlling the speed of said mtoor in a manner minimizing said difference signal.

7. Apparatus according to claim 6, in which said means for defining a measuring interval includes means for determining the beginning of said internal by detecting when said signal representative of actual rotary speed first exceeds a predetermined value during start-up of said motor and timing circuit means for fixing the duration and time of termination of said interval.

8. Apparatus according to claim 6, in which means are provided for reducing the operating voltage of said electric motor during start-up thereof at least until the end of said measuring interval.

* * * * *